US007905331B2

(12) United States Patent
Sittler

(10) Patent No.: US 7,905,331 B2
(45) Date of Patent: Mar. 15, 2011

(54) CAR WALL ARRANGEMENT FOR AN ELEVATOR CAR

(75) Inventor: Denis Sittler, Illzach (FR)

(73) Assignee: Inventio AG, Hergiswil (CH)

( * ) Notice: Subject to any disclaimer, the term of this patent is extended or adjusted under 35 U.S.C. 154(b) by 635 days.

(21) Appl. No.: 11/796,969

(22) Filed: Apr. 30, 2007

(65) Prior Publication Data

US 2007/0251409 A1 Nov. 1, 2007

(30) Foreign Application Priority Data

Apr. 28, 2006 (EP) ..... 06113301

(51) Int. Cl.
*B66B 11/02* (2006.01)
*B25G 3/28* (2006.01)
*E04B 2/00* (2006.01)

(52) U.S. Cl. ..... 187/401; 403/358; 52/29; 52/30; 52/570; 52/581; 52/582.1

(58) Field of Classification Search ..... 187/401; 52/30, 79.9, 570, 588.1, 586.2; 403/354, 403/358; *B66B 11/02*
See application file for complete search history.

(56) References Cited

U.S. PATENT DOCUMENTS

| | | | | |
|---|---|---|---|---|
| 3,632,146 | A | 1/1972 | Buzby et al. | |
| 4,357,993 | A * | 11/1982 | Halpern et al. | 187/401 |
| 4,430,838 | A * | 2/1984 | Bains | 52/584.1 |
| 5,428,932 | A * | 7/1995 | Gruber | 52/587.1 |
| 5,676,486 | A | 10/1997 | Keith | |
| 5,842,545 | A | 12/1998 | Blaiotta | |
| 6,082,501 | A | 7/2000 | Lehmann | |

FOREIGN PATENT DOCUMENTS

| | | |
|---|---|---|
| DE | 2453196 | 5/1976 |
| EP | 1 236 836 | 9/2002 |
| ES | 2 024 774 | 3/1992 |
| WO | WO 03045829 A1 * | 6/2003 |

* cited by examiner

*Primary Examiner* — Michael R Mansen
*Assistant Examiner* — Stefan Kruer
(74) *Attorney, Agent, or Firm* — Wolff & Samson, PC

(57) ABSTRACT

A car wall arrangement for an elevator car having a first car wall, on whose outside is arranged at least one first joining element with a first flange that projects beyond a first end-face of the first car wall and is angled from the outside by a joining angle that is greater than 180° and less than 360°. A second car wall is provided on whose outside is arranged at least a second joining element with a second flange that projects beyond a second end-face of the second car wall. The second flange is turned away from the outside of the second car wall by the same joining angle α so that in the installed state the first flange rests against the outside of the second car wall and the second flange against the outside of the first car wall.

18 Claims, 4 Drawing Sheets

CAR WALL ARRANGEMENT FOR AN ELEVATOR CAR

BACKGROUND OF THE INVENTION

The present invention relates to an arrangement of car walls for an elevator car.

Elevator cars, particularly in passenger elevators, have several essentially vertical car walls which, arranged adjacent to each other, bound the internal space. Since, during building construction, the elevator hoistway is sometimes first completed to such an extent that the complete elevator car in its entirety can no longer be inserted into the elevator hoistway, the elevator car must be subsequently assembled from individual components inside the hoistway. For this purpose, the individual car walls should be easy to assemble with each other, as far as possible from the inside. For maintenance, for the replacement of damaged car walls, or for the replacement of the entire elevator car, such as in the case of a modernization, the individual car walls should also be easy to disassemble again.

For this purpose, U.S. Pat. Nos. 5,842,545 and 6,082,501 respectively propose car walls of metal sheeting in which on a vertical end-face of a car wall a hook-shaped flange that is angled toward the inside engages with a hook-shaped flange that is angled toward the outside on an abutting end-face of an adjacent car wall. The outwardly angled flange projects beyond the outside of the car wall and disadvantageously enlarges the total external dimension the elevator car. Furthermore, the projecting flanges are susceptible to the effects of forces from outside that can damage the flange connection and thereby either loosen the connection of the car walls or, conversely, cause the flanges to be bent together in such manner that they can no longer be released.

U.S. Pat. No. 4,357,993 and DE 24 53 196 A1 show as alternative an elevator car in which flanges that project from a first car wall beyond its end-face engage from above in vertical recesses in the adjacent car wall or in recesses in flanges that project from the adjacent car wall beyond its end-face. Here, too, flanges project disadvantageously that enlarge the overall dimension of the elevator car and are susceptible to damage.

U.S. Pat. No. 3,632,146 discloses an elevator car with a car wall arrangement, having a first car wall on whose outside a first flange is arranged that projects beyond a first end-face of the car wall and is angled by 270° from the outside. Arranged on the outside of an adjacent car wall is a second flange that projects parallel to the outside beyond the second car wall and engages vertically from below in a recess of the first flange. In this arrangement, too, both flanges project beyond the outside of the car walls in such manner that they disadvantageously enlarge the external dimension of the elevator car and are susceptible to damage from outside.

SUMMARY OF THE INVENTION

The task of the present invention is therefore to create a car-wall arrangement for an elevator car that in the installed state enlarges the external size of the elevator car only slightly or not at all.

This purpose is fulfilled by a car-wall for an elevator car according to the invention that comprises a first car wall, on whose outside that faces away from the inside of the car is arranged at least one first joining element with a first flange that projects beyond a first end-face of the first car wall and is angled from the outside at a joining angle that is greater than 180° and less than 360°. This flange thus contains an interior angle greater than 0° and less than 180° to the vertical plane of the first car wall and is angled toward the inside of the car. In the case of a right-angled elevator car, the joining angle according to the invention is, for example, essentially 270°, which corresponds to an interior angle of 90° to the vertical plane. For example, in the case of a hexagonal or octagonal elevator car, the joining angle according to the invention is correspondingly approximately 240° or 225° respectively, etc. The total number of car floor plans that are possible is unlimited, the joining angle according to the invention always corresponds to the angle between the outside of the first car wall and an adjacent second car wall.

An arrangement of car walls for an elevator car according to the invention also comprises a second car wall, on whose outside that faces away from the inside of the car is arranged at least one second joining element with a second flange that projects beyond a second end-face of the second car wall and is turned away from the outside of the second car wall by the same joining angle.

Consequently, in the installed state, the first flange lies against the outside of the second car wall and the second flange, which can be arranged correspondingly lower, lies against the outside of the first car wall. Thus, in a car wall arrangement according to the invention, the flange projects only a little or not at all beyond the outsides, and thus the external dimensions of the elevator car are essentially determined by the outsides themselves. Also, the flanges that rest against the outsides are well protected against mechanical damage.

The car wall arrangement of the present invention can be easily installed from inside: After the second car wall has been erected in its vertical position, the first car wall with its first end-face is placed against the second end-face of the second wall and then turned about its vertical edge, whereby the first flange and the second flange embrace the outside of the respective other car wall and thereby hold the two car walls against each other by positive engagement. In the opposite sequence, the walls can also be uninstalled. Self-evidently, also in the opposite sequence, the first car wall can be erected in its vertical position and the second car wall then placed against it.

Against the free end-face of the first and/or second car wall a further car wall can be fastened in the same way, so that the entire walling of the elevator car can be easily installed and uninstalled from within.

In a preferred embodiment of the present invention, the first joining element in the form of a corner section embraces the first flange and a third flange that is bent around the joining section and fastened to the first flange and fastened on the outside of the first car wall in such manner that in the installed state its lower end-face touches the upper end-face of the second flange of the second joining element. The third flange can be joined to the outside releasably, for example by means of screws or pluggable connectors, or non-releasably, for example by means of adhesive bonding or welding. In particular, the outside and the third flange can also be executed integrally, for example as a molding.

The upper end-face of the second flange, that in the installed state rests against the outside of the first car wall, touching the lower end-face of the third flange that is fastened to this outside, and the car walls being fastened by positive engagement in the horizontal direction by the first and second flange, that in each case mutually embrace the respective other outside, cause additionally a positively engaged fixing in vertical direction through the third flange that rests from above on the second flange and thereby prevents a movement of the second car wall in upward direction or a movement of the first car wall in downward direction.

In an advantageous further development of the present invention described above, the lower end-face of the third flange and the upper end-face of the second flange slope relative to the horizontal. With this embodiment, during installation the first car wall is placed with its end-face slightly higher than the second car wall, turned about its end-face until the first and second flange rest against the respective outside, and then the first car wall lowered in downward direction. When this is done, the sloping end-faces of the second flange and third flange slide over each other and position the first car wall at the desired horizontal distance from the second car wall.

In the installed position, the embracing first flange prevents a horizontal movement of the first car wall away from the second car wall, and the touching end-faces of the second and third flange prevent a horizontal movement of the first car wall toward the second car wall. This is because these end-faces would then slide on each other and force the first car wall vertically upward. However, firstly, such an offset acts against the own weight of the first car wall. Secondly, the car roof and car floor can be advantageously, for example by means of tie rods, tensioned against each other in vertical direction and embrace the car wall arrangement between them so that especially the car roof also prevents a vertical offset of the first car wall and thereby, because of the sloping end-faces, also a horizontal movement relative to the second car wall. It is therefore preferable for the second flange to taper toward its vertical end-face that is distant from the second car wall, i.e. the slope runs downward in the direction of the first car wall.

In a further preferred embodiment of the present invention, that can also possess the characteristics of the embodiments described above, the second joining element in the form of a corner section embraces the second and a fourth flange, that is joined to the second flange and fastened onto the outside of the second car wall, in such manner that in the installed state its upper end-face touches the lower end-face of the first flange of the first joining element. Like the third flange, the fourth flange can be joined to the outside releasably, for example by means of screws or plug connectors, or non-releasably, for example by means of adhesive bonding or welding. In particular, the outside and the fourth flange can be also be executed integrally, for example as a molding.

This embodiment brings the same advantages as the preferred embodiment that is described above. Through the upper end-face of the first flange, that in the installed state rests against the outside of the second car wall, touching the upper end-face of the fourth flange that is fastened to this outside, and the car walls being fastened by positive engagement in the horizontal direction by the first and second flange, results additionally also a positively engaged fixing in vertical direction through the first flange that rests from above on the fourth flange and thereby prevents a movement of the second car wall in upward direction or a movement of the first car wall in downward direction.

In an advantageous further development of the preferred embodiment of the present invention described above, the lower end-face of the first flange and the upper end-face of the fourth flange slope relative to the horizontal. With this embodiment, as with the further development described above, whose characteristics can be realized in addition, during installation the first car wall is placed with its end-face slightly higher than the second car wall, turned about its end-face until the first and second flange rest against the respective outside, and then the first car wall lowered in downward direction. When this is done, the sloping end-faces of the first and fourth flange slide over each other and position the first car wall at the desired horizontal distance from the second car wall and fix the former relative to the latter. For this purpose, it is therefore preferable for the first flange to taper toward its vertical end-face that is distant from the first car wall, i.e. the slope runs upward in the direction of the second car wall.

If the two advantageous embodiments that are described above are combined, it is possible in a preferred embodiment of the present invention for the lower end-face of the first and third flange to slope in the same direction and in particular to have the same angle relative to the horizontal. By this means, the guidance during lowering is lengthened, and on account of the greater supporting surface, the two car walls are fixed more reliably in their position relative to each other. Conversely, the lower end-faces of the first and third flanges can also slope in opposite directions, in particular having the same size of joining angle relative to the horizontal. It is preferable for the first and third flanges to form at their point of joining a recess that is downwardly open, into which a complementary point engages, which is formed at the joining point between the second and fourth flange. Conversely, a point that is formed by the first flange and third flange can engage in a corresponding recess between the second flange and third flange. In the case of an opposite slope, the resulting point advantageously fixes the two car walls in the two horizontal directions, i.e. the two car walls can neither be pushed toward each other nor away from each other horizontally, since on account of their own weight and if applicable also that of the car roof resting on them from above, they act counter to the sloping end-faces sliding over each other. Alternatively, only the edge-faces of the first and fourth flanges, or only of the second and third flanges, can be sloping, the others being essentially horizontal.

In a preferred embodiment of the present invention, in the installed state the first flange engages in a recess on the outside of the second car wall and/or the second flange engages in a recess on the outside of the first car wall. By this means, the overall external dimension can be further reduced and the flange even better protected against damage.

In an advantageous embodiment, in the installed state the second end-face of the second car wall rests against the third flange, or the first end-face of the first car wall rests against the fourth flange, in such manner that a horizontal movement of the one car wall beyond the outside of the other is prevented. In the same way, the third and fourth flanges respectively can have spacers that rest against the second and third end-faces respectively, and secure the latter against a horizontal movement against this flange.

In a preferred embodiment of the present invention, in the installed state a gap for ventilation of the elevator car remains between the first and the second end-faces. This can be secured by, for example, horizontal fixing by means of sloping upper or lower end-faces and/or resting of an end-face of a car wall against the flange of the other car wall or against corresponding spacers as described above.

If the first and/or second car wall are advantageously formed as plates of sandwich construction with greater wall thickness instead of the metal sheeting usual until now, which particularly improves the thermal and acoustic insulation, provided that the car walls are not joined to each other vertically from above but by turning about a vertical axis, a certain amount of gap inevitably remains. Since when this turning takes place, in which the vertical edges of the first end-face and second end-face respectively that face away from each other and slide on the inside of the second flange and first flange respectively, the two vertical edges of the end-faces that face each other must be able to pass the respective other car wall without penetration. Therefore, the greater the wall thicknesses of the first car wall and second car wall, i.e. the further apart the vertical edges of the end-faces that face toward each other and away from each other, the greater in installed state is the remaining gap that is needed to fasten the two car walls to each other by turning horizontally. In the same manner there can be only one gap between an end-face of the one car wall and the inside of the other car wall, while the end-face of the other car wall rests flush against the flange of the one car wall. In the same way, between the two end-faces and the insides of the car-walls that face each other, gaps can also remain that can then be embodied smaller than one single gap.

In particular, with a preferred car-wall arrangement as described above, whose first and second car wall are embodied as plate elements with a particular wall thickness, for example in sandwich construction, and on installation by horizontal turning of the two car walls toward each other, a gap remains between at least one end-face of the one car wall and the inside of the other car wall, the embodiment that was explained above of the mutually touching upper and lower end-faces of the first and fourth, or third and second flange as sloping end-faces is advantageous. This is because, as described above, the two car walls can also be fixed relative to each other in their horizontal degrees of freedom so that the play that is caused by the gap that is necessary for installation is reduced or preferably largely eliminated. On account of the sloping end-faces of the first flange and fourth flange and/or of the second flange and third flange that touch each other, that car wall between whose end-face and the inside of the other car wall a gap remains cannot move in the direction of the gap.

In a preferred embodiment of the present invention, the first flange has on its lower end-face that faces the fourth flange a corresponding recess in which in the installed state a corresponding projection on the end-face of the fourth flange engages. In the same way, the projection can be embodied on the first flange and the recess on the fourth flange. Additionally or alternatively, the second flange has on its upper end-face that faces toward the third flange a recess in which in the installed state a corresponding projection on the end-face of the third flange engages. Here too, in the same way, the projection can be embodied on the second flange and the recess on the third flange. By this means, horizontal pulling apart of the car walls is effectively prevented.

It is preferable for the first and second car walls to have several, and preferably different, joining elements according to the invention.

Further purposes, characteristics, and advantages of the present invention follow from the claims and exemplary embodiments.

BRIEF DESCRIPTION OF THE DRAWINGS

Shown are in

DETAILED DESCRIPTION OF THE INVENTION

Figure 1:
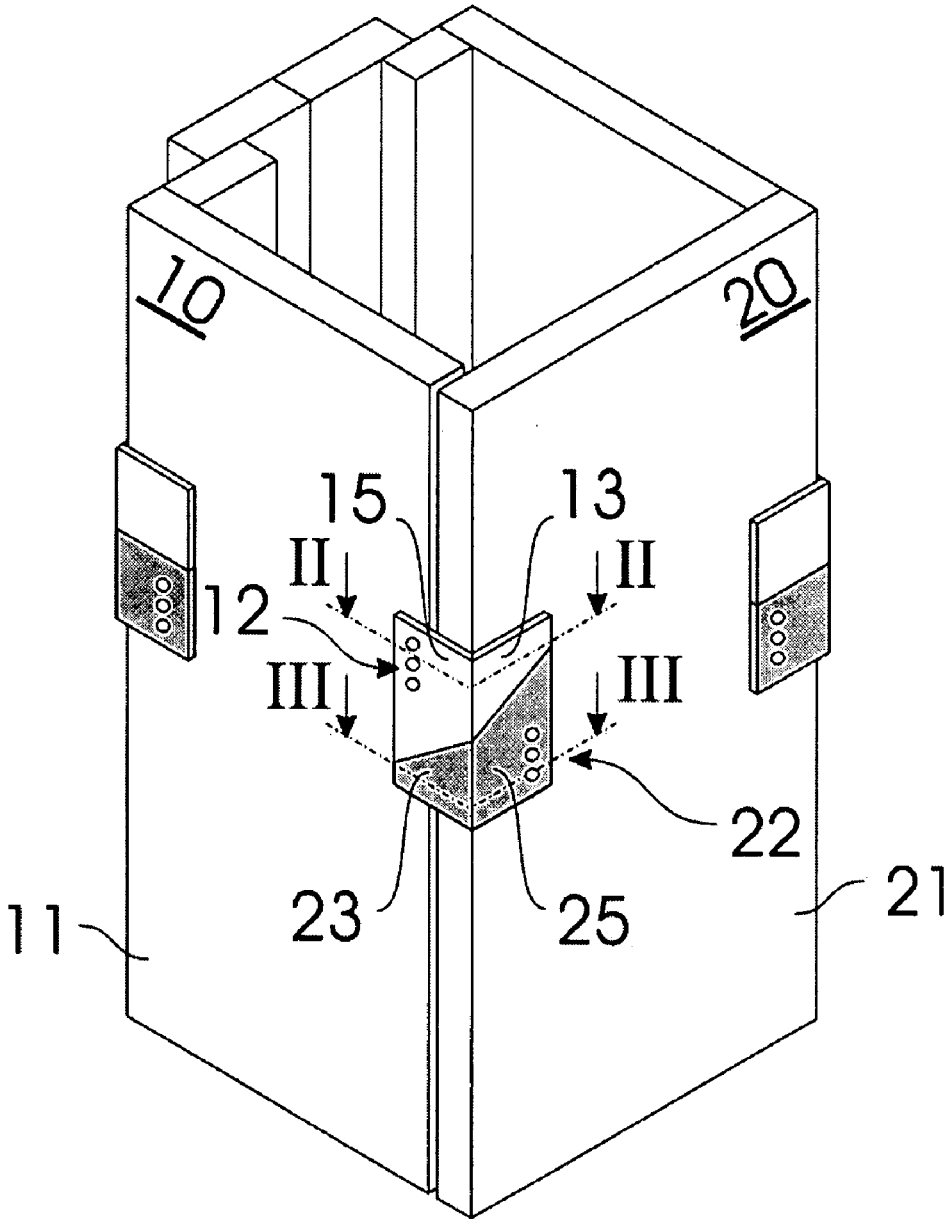
FIG. 1 in diagrammatic three-dimensional view with the car roof omitted, an elevator car with a car-wall arrangement according to a first embodiment.

FIG. 1 shows diagrammatically in three-dimensional view an elevator car with a car-wall arrangement according to the invention from which for clarity the car roof has been removed. The car wall arrangement comprises in particular a first car wall 10 in the form of a left side wall and a second car wall 20 in the form of a rear wall. However, this arrangement is arbitrary—in particular, as shown in FIG. 1, a car wall arrangement as shown in FIG. 1 can also comprise a right side wall and a left or right front wall, each of these walls being able to form a first or second car wall. In a further not shown embodiment with non-rectangular (for example hexagonal) car floor plan, it is also possible, for example, for two adjacently located side walls to form a first and second car wall.

Fastened by means of screws to the first car wall 10 is a first joining element 12 in the form of a corner section. This corner section, that can be made, for example, of metal, in particular of steel or aluminum, comprises a third flange 15 that is screwed onto the outside 11 of the first car wall 10. In a further embodiment that is not shown, this flange can also be embodied integrally with the outside, for example welded to the latter. The joining element further comprises a first flange 13 which, relative to the outside 11, or third flange respectively, is angled at a joining angle $\alpha$ of 270° to the car interior.

In the installed state shown in FIG. 1, this first flange 13 embraces the outside 21 of the second car wall 20 and rests against it. Fastened in similar manner onto the second car wall 20 by means of screws is a second joining element 22 in the form of a corner section that can also be made, for example, of metal, particularly steel, and that contains a fourth flange 25 that is screwed onto the outside 21 of the second car wall 20. Alternatively, in a further not shown embodiment, this flange can also be embodied integrally with the outside, for example welded to the latter. The second joining element further contains a second flange 23 which, relative to the outside 21 or fourth flange respectively, is angled at the same joining angle $\alpha$ of 270° to the car interior and in the installed state embraces the outside of the first car wall 10 and rests against it.

In the direction from the third to the first flange, the lower end-faces of the first and third flanges 13, 15 slope upwards and have the same angle relative to the horizontal. In the direction from the fourth to the second flange, the upper end-faces of the second and fourth flanges 23, 25 slope downward and have the same angle relative to the horizontal so that in the installed state the upper and lower end-faces respectively of the four flanges 13, 15, 23, and 25 touch over a large area.

For installation, the second car wall 20 is first joined to the structure of the elevator car by being, for example, lowered from above into a surrounding groove in the car floor that is not shown. Alternatively or additionally, the second car wall can also be screwed to the elevator floor or its frame by means of, for example, a corner section. Subsequently, the first car wall 10 with its first end-face 14 beyond which the first flange 13 projects, is laid linearly flush against the second end-face 24 of the second car wall, the first car wall 10 being upwardly offset in vertical direction relative to its final position. Subsequently, as indicated by an arrow in FIG. 4*a*, the first car wall is turned about its first end-face 14, upon which the vertical edges of the end-faces that face away from each other slide on the inside of the first and second flanges respectively until the first flange 13 rests against the outside 21 of the second car wall 20. At the same time, the vertical edges of the end-faces that face each other move past each other without penetrating the other car wall. Depending on the wall thickness of the car walls, in finally turned position a certain amount of gap remains between the two car walls (see FIGS. 2, 3). Following this, as indicated by an arrow in FIG. 4*b*, the first car wall is lowered vertically down relative to the second car wall into the final installation position, in which the lower end-faces of the first and third and the upper end-faces of the second and fourth flanges touch over a large area. The end-faces sliding over each other thereby automatically move the flange of the first car wall in horizontal direction into its end position relative to the second car wall. In the vertical end position, the first car wall also engages in the surrounding groove in the car floor.

In this installed position, the first car wall is fixed in the horizontal degrees of freedom on the second car wall by the two joining elements 12, 22: movement of the first car wall 10 in its plane vertically away from the second car wall (in FIG. 2 to the left) is counteracted by the first flange 13 that embraces with positive engagement the outside 21 of the second car wall 20. Horizontal movement in the opposite direction acts against the third flange 15. In the case of a corresponding movement, the latter would slide upward over the sloping end-face of the second flange—however, such a movement is counteracted by the own weight of the first car wall as well as the car roof that is finally fastened on to it. This (not shown) car roof can, for example, be tensioned by means of tie rods to the car floor and fix the car walls in vertical direction. A horizontal movement of the first car wall 10 perpendicular to the directions explained above, thus in the plane of the second car wall 20 (upward/downward respectively in FIG. 2) is counteracted in similar manner by the second flange 23 and the third flange 15 respectively, the third flange 15 resting via the first flange 13 on the fourth flange 25.

The first car wall can thus be rapidly fastened onto the second car wall without additional tools and from the inside. Further car walls can also be installed in similar manner, as indicated in FIG. 1. In reverse sequence, the car walls can also be easily dismantled.

Figure 2:
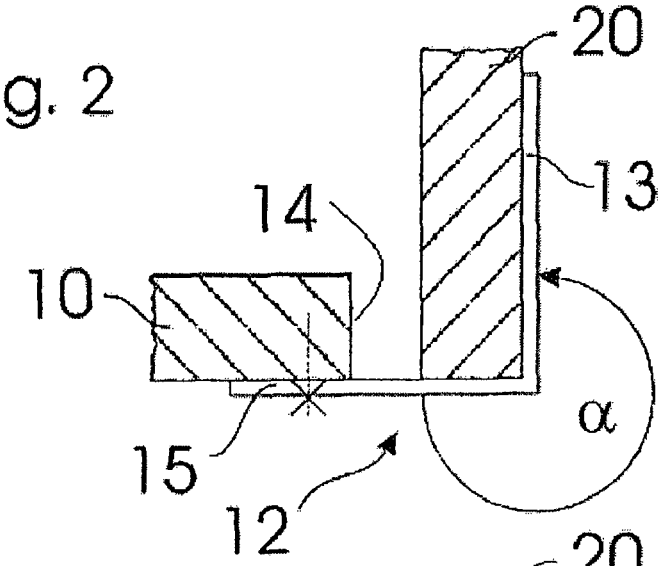
FIG. 2 a partial horizontal cross section of the car wall arrangement along the line II-II in FIG. 1.
Figure 4A:
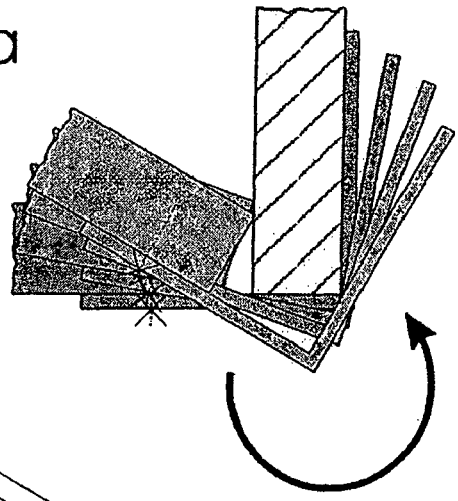
FIGS. 4*a*, 4*b* diagrammatically, the installation of a car wall arrangement according to the invention.

As FIG. 2 shows, in the embodiment that is shown here, in the installed state a gap remains between the first end-face 14 of the first car wall 10 and the inside of the second car wall 20, that is needed for coupling the first car wall 10 to the second car wall 20 on account of the effect of the wall thickness, as can be seen from FIG. 4*a*. Advantageously, the gap serves to ventilate the car. During installation, the first end-face 14 can also be laid against the inside of the second car wall 20. During the subsequent lowering, the lower end-faces of the first and third flanges 13, 15 slide over the upper end-faces of the second and fourth flanges 23, 25 and, on account of the complementary slope, inevitably guide the first car wall into the desired horizontal position, i.e. maintain a gap between the first car wall and the second car wall.

Figure 3:
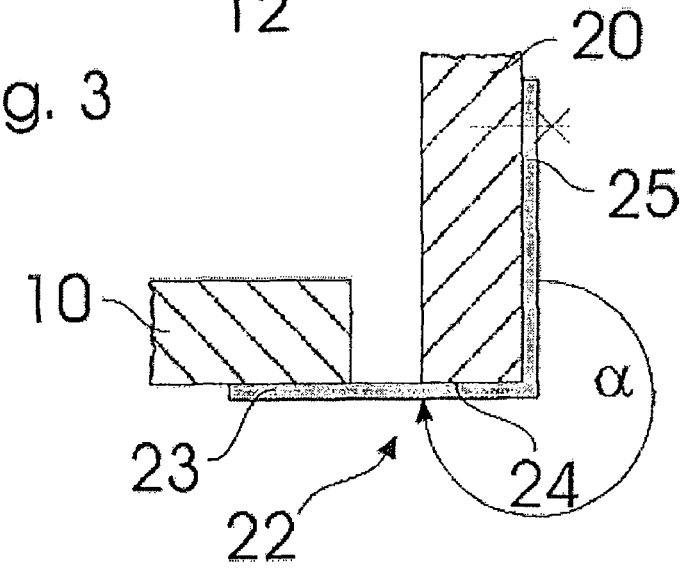
FIG. 3 a partial cross section corresponding to FIG. 2 along the line III-III in FIG. 1.
Figure 5:
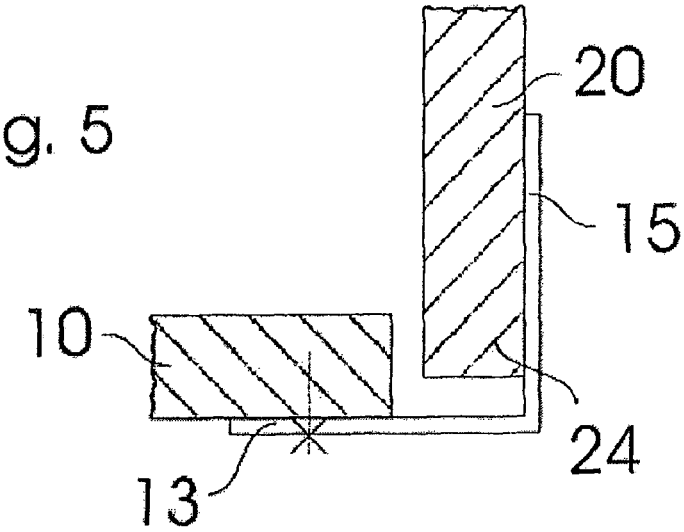
FIG. 5 a partial cross-section according to FIG. 2 of a second embodiment of the present invention.
Figure 4B:
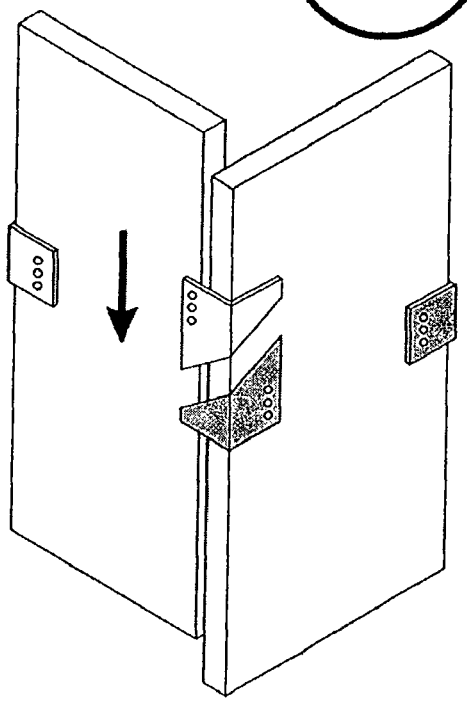

As shown in FIGS. 2, 3, in the installed state, the second end-face 24 of the second car wall 20 rests flush against the third flange 15. In a second embodiment according to FIG. 5, a gap can also remain between the first end-face 14 and the inside of the second car wall 20 as well as between the second end-face 24 and the inside of the first car wall 10 through the end-faces of the flanges being correspondingly formed. In this case, each of the two gaps can be smaller than the single gap according to FIG. 2, with installation being possible nevertheless, i.e. the two vertical edges of the end-faces that face each other move past each other without penetration, when the edges that face away from each other slide on the inside of the flange (see FIG. 4*a*).

In a further embodiment that is not shown, the outsides 11 and/or 22 of the first and/or second car wall 10, 20 respectively have recesses in which in the installed state the first and/or second flange(s) engage(s). The recesses can be made correspondingly bigger, so as to allow during installation the swiveling-in and lowering movement described above. In such an embodiment, the joining elements are even better protected against damage from outside and do not cause any increase at all in the external dimensions of the elevator car.

Figure 6:
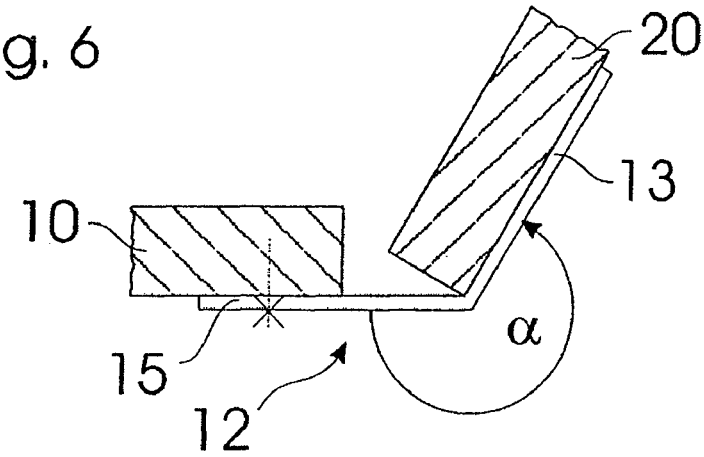
FIG. 6 a partial cross-section according to FIG. 2 of a third embodiment of the present invention; and in FIG. 7 a three-dimensional view corresponding to FIG. 1 of an elevator car with a car wall arrangement according to a fourth embodiment of the present invention.

FIG. 6 shows a cross section corresponding to FIG. 2 of a third embodiment, in which the size of the joining angle $\alpha$ is not 270° but only 240°. This allows, for example, a hexagonal car floor plan to be created. Depending on the car floor plan, other joining angles are also possible that result from the end position of the car walls relative to each other.

Figure 7:
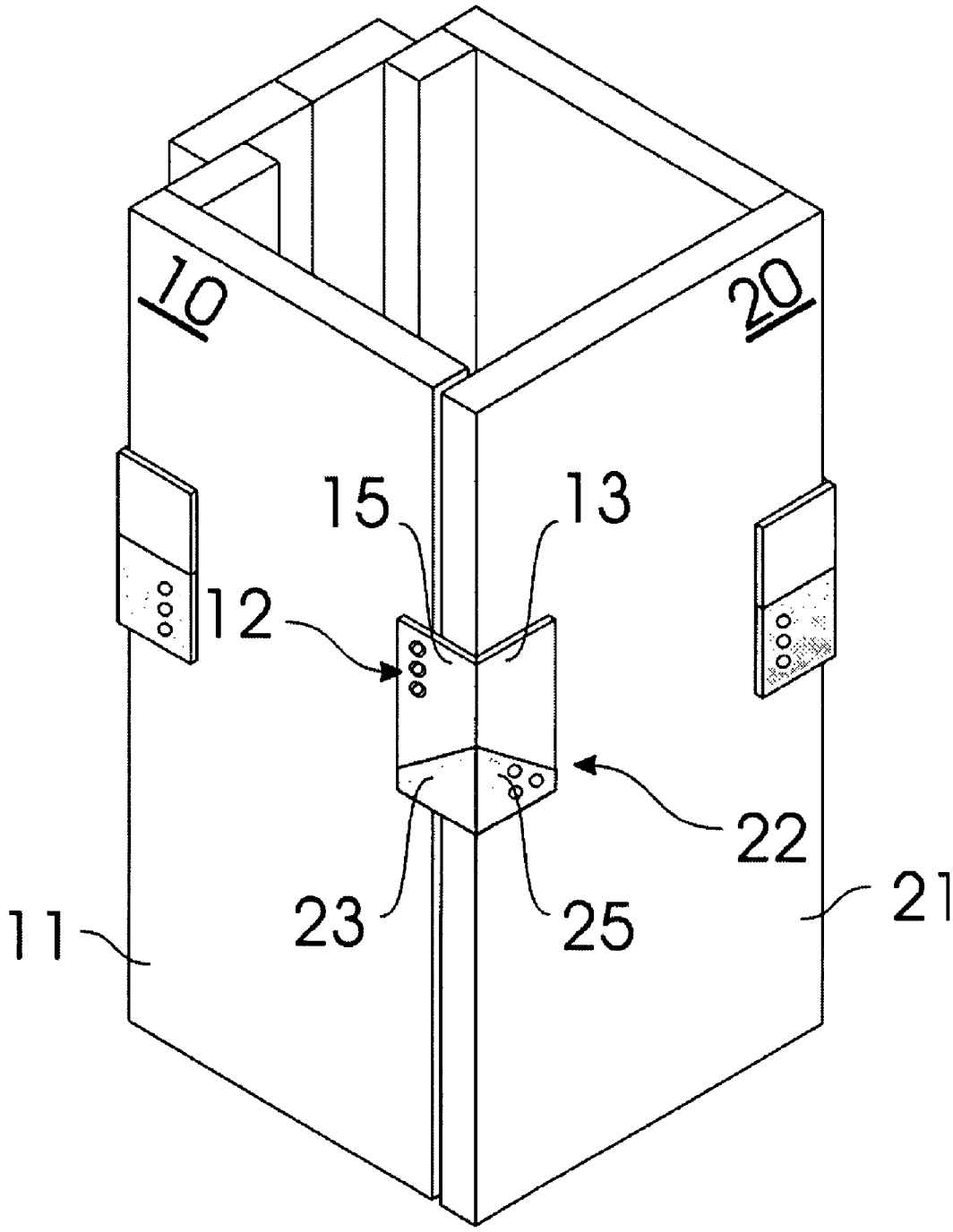

FIG. 7 shows a fourth embodiment of the present invention in which the lower end-faces of the first and third flanges 13, 15 slope oppositely as do also the upper end faces of the second and fourth flanges 23, 25. In the installed state, when being lowered the first car wall 10 centers relative to the second car wall 20 and fixes both walls in all horizontal degrees of freedom.

In the same way, the lower end-face of the first flange 13 and the complementary upper end-face of the fourth flange 25 and/or the lower end-face of the third flange 15 and the complementary upper end-face of the second flange 23 do not slope but run essentially horizontally as indicated/outlined in the joining elements of the first car wall 10 to the front wall and of the second car wall 20 to the right side wall in FIGS. 1 and 7.

Although the present invention has been described in relation to particular embodiments thereof, many other variations and modifications and other uses will become apparent to those skilled in the art. It is preferred, therefore, that the present invention be limited but by the specific disclosure herein, but only by the appended claims.

The invention claimed is:

1. A car wall arrangement for an elevator car comprising:

a first car wall having an outside that faces away from an interior of the car, at least a first joining element being attached to the outside of the first car wall and having a first flange being arranged to project beyond a first end-face of the first car wall, and being angled by an exterior joining angle ($\alpha$) that is greater than 180° and less than 360°; and a second car wall having an outside that faces away from the interior of the car, at least a second joining element being attached to the outside of the second car wall and having a second flange being arranged to project beyond a second end-face of the second car wall, the second flange being angled to the outside of the second car wall by said joining angle ($\alpha$), so that in an installed state, the first flange rests against the outside of the second car wall and the second flange rests against the outside of the first car wall, wherein the first joining element is formed as a corner section that comprises the first flange and a third flange that is joined to the first flange and fastened onto the outside of the first car wall so that in the installed state a lower end-face of the third flange touches an upper end-face of the second flange of the second joining element.

2. The car wall arrangement according to claim 1, wherein the lower end-face of the third flange and the upper end-face of the second flange slope relative to horizontal.

3. The car wall arrangement according to claim 2, wherein the second joining element is formed as a corner section that comprises the second flange and a fourth flange that is joined to the second flange and fastened onto the outside of the second car wall so that in the installed state an upper end-face of the fourth flange touches a lower end-face of the first flange of the first joining element.

4. The car wall arrangement according to claim 3, wherein the lower end-face of the first flange and the upper end-face of the fourth flange slope relative to horizontal.

5. The car wall arrangement according to claim 4, wherein the lower end-face of the first and third flanges slope in a common direction.

6. The car wall arrangement according to claim 5, wherein the lower end-face of the first flange and the lower end-face of the third flange slope at a same angle relative to horizontal.

7. The car wall arrangement according to claim 1, wherein the second joining element is formed as a corner section that comprises the second flange and a fourth flange that is joined to the second flange and fastened onto the outside of the second car wall so that in the installed state an upper end-face of the fourth flange touches a lower end-face of the first flange of the first joining element.

8. The car wall arrangement according to claim 7, wherein the lower end-face of the first flange and the upper end-face of the fourth flange slope relative to horizontal.

9. The car wall arrangement according to claim 1, wherein first car wall and/or the second car wall is embodied in plate form.

10. The car wall arrangement according to claim 9, wherein the car wall has a sandwich construction.

11. The car wall arrangement according to claim 4, wherein the lower end-faces of the first and third flanges slope in opposite directions.

12. The car wall arrangement according to claim 11, wherein the lower end-faces of the first and third flanges slope at a same angle relative to horizontal.

13. The car wall arrangement according to claim 1, wherein the joining angle lies in a range of 210° to 270°.

14. The car wall arrangement according to claim 1, wherein a recess is provided on the outside of the second car wall so that at least in the installed state the first flange engages in the recess.

15. The car wall arrangement according to claim 1, wherein a recess is provided on the outside of the second car wall so that at least in the installed state the second flange engages in the recess.

16. The car wall arrangement according to claim 1, wherein the first and second joining elements are embodied so that in the installed state the second end-face rests against the third flange.

17. The car wall arrangement according to claim 1, wherein the first and second joining elements are embodied so that in the installed state a gap remains between the first end-face and the second end-face.

18. An elevator car comprising a car wall arrangement having:

a first car wall having an outside that faces away from an interior of the car, at least a first joining element being attached to the outside of the first car wall and having a first flange being arranged to project beyond a first end-face of the first car wall, and being angled by an exterior joining angle ($\alpha$) that is greater than 180° and less than 360°; and a second car wall having an outside that faces away from the interior of the car, at least a second joining element being attached to the outside of the second car wall and having a second flange being arranged to project beyond a second end-face of the second car wall, the second flange being angled to the outside of the second car wall by said joining angle ($\alpha$), so that in an installed state, the first flange rests against the outside of the second car wall and the second flange rests against the outside of the first car wall, wherein the first joining element is formed as a corner section that comprises the first flange and a third flange that is joined to the first flange and fastened onto the outside of the first car wall so that in the installed state a lower end-face of the third flange touches an upper end-face of the second flange of the second joining element.

* * * * *